US009070331B2

(12) United States Patent
Jang et al.

(10) Patent No.: US 9,070,331 B2
(45) Date of Patent: Jun. 30, 2015

(54) LIQUID CRYSTAL DISPLAY DEVICE AND METHOD FOR DRIVING THE SAME

(75) Inventors: Su-Hyuk Jang, Paju-si (KR); Hwan-Joo Lee, Daegu (KR); Jong-Woo Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 507 days.

(21) Appl. No.: 13/339,204

(22) Filed: Dec. 28, 2011

(65) Prior Publication Data

US 2012/0169788 A1 Jul. 5, 2012

(30) Foreign Application Priority Data

Dec. 31, 2010 (KR) ..... 10-2010-0140737

(51) Int. Cl.
*G09G 3/36* (2006.01)

(52) U.S. Cl.
CPC ..... *G09G 3/3614* (2013.01); *G09G 3/3685* (2013.01); *G09G 2310/0251* (2013.01); *G09G 2350/00* (2013.01)

(58) Field of Classification Search
CPC .. G09G 3/3611; G09G 3/3648; G09G 3/3688
USPC ..... 345/99, 100
See application file for complete search history.

(56) References Cited

U.S. PATENT DOCUMENTS 8,289,251 B2 10/2012 Tsubata
8,519,943 B2 8/2013 An et al.
8,542,228 B2 9/2013 Sugihara et al.
2003/0161189 A1* 8/2003 Park ..... 365/189.07
2006/0262069 A1 11/2006 Do et al.
2006/0274016 A1 12/2006 Ito et al.
2007/0279433 A1* 12/2007 Huang ..... 345/601
2008/0158266 A1* 7/2008 So ..... 345/690
2010/0188374 A1 7/2010 Chen et al.

FOREIGN PATENT DOCUMENTS

CN 101414089 A 4/2009
CN 101467200 A 6/2009
CN 101896961 A 11/2010
JP 2004-240263 A 8/2004
JP 2009-222943 A 10/2009
KR 10-2008-0062531 A 7/2008

* cited by examiner

*Primary Examiner* — Roy Rabindranath
(74) *Attorney, Agent, or Firm* — Birch, Stewart, Kolasch & Birch, LLP

(57) ABSTRACT

A liquid crystal display and a method for driving the same, which improve image quality by increasing data line charge speed, are provided. In the display, a preparatory charging controller receives current image data to be provided to m current pixels of an nth horizontal line and a current vertical polarity-reversal control signal for vertically controlling polarities of the current image data, compares current image data with previous data provided to m corresponding previous pixels of an n−1th horizontal line, compares the current control signal with a previous one, and determines a logic value of a preparatory charging control signal based on the comparison. A data driver performs either a first operation for connecting and separating m data lines connected respectively to m current pixels, or a second operation for maintaining the m data lines separated, according to the logic value and provides the current data to the m pixels.

15 Claims, 12 Drawing Sheets

| G_Mode1 | G_Mode2 | Output |
|---|---|---|
| L | L | Charge Share |
| H | L | Hi-Z |

LIQUID CRYSTAL DISPLAY DEVICE AND METHOD FOR DRIVING THE SAME

This application claims the benefit of Korean Patent Application No. 10-2010-0140737, filed on Dec. 31, 2010, which is hereby incorporated by reference as if fully set forth herein.

BACKGROUND OF THE INVENTION

1. Field of the Invention

The present invention relates to a liquid crystal display device, and more particularly, to a liquid crystal display device and a method for driving the same which can improve image quality by increasing charge speed of data lines.

2. Discussion of the Related Art

The liquid crystal display device performs a polarity reversal operation to prevent deterioration of liquid crystal. However, due to such polarity reversal, each data line may fail to be sufficiently charged with image data.

SUMMARY OF THE INVENTION

Accordingly, the present invention is directed to a liquid crystal display device and a method for driving the same that substantially obviate one or more problems due to limitations and disadvantages of the related art.

An object of the present invention is to provide a liquid crystal display device and a method for driving the same, wherein image data of a previous horizontal line and a current horizontal line are compared, polarity reversal control signals of the horizontal lines, which control the polarities of the image data of the horizontal lines, are also compared, and data lines are connected to each other or separated from each other according to results of the comparisons, thereby rapidly and efficiently charging the data lines according to data characteristics.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a preparatory charging controller that receives, from a timing controller, current image data that are to be provided to m current pixels, where m is a natural number, among a plurality of pixels located at an nth horizontal line, where n is a natural number, and a current vertical polarity reversal control signal for controlling polarities of the current image data in a vertical direction, compares the current image data with previous image data that have been provided to m previous pixels corresponding to the current m pixels among a plurality of pixels located at an n−1th horizontal line, compares the current vertical polarity reversal control signal with a previous vertical polarity reversal control signal for controlling polarities of the previous image data in a vertical direction, and determines a logic value of a preparatory charging control signal based on results of the comparisons, and a data driver that performs one of a first operation, in which the data driver connects m data lines connected respectively to the m current pixels to each other and again separates the m data lines from each other, and a second operation, in which the data driver keeps the m data lines separated from each other, according to the logic value of the preparatory charging control signal from the preparatory charging controller and then provides the current image data from the timing controller to the m pixels.

The preparatory charging controller compares k most significant bits of the current image data with k most significant bits of the previous image data, where k is a natural number.

The preparatory charging controller includes a most significant bit extractor that receives current image data and a current vertical polarity reversal control signal from the timing controller and extracts current most significant bits corresponding to k most significant bits from the current image data, a storage unit that stores current most significant bits and a current vertical polarity reversal control signal from the most significant bit extractor, a previous vertical polarity reversal control signal and previous most significant bits corresponding to k most significant bits of the previous image data have already been stored in the storage unit, and a preparatory charging determinator that compares the current most significant bits from the most significant bit extractor with the previous most significant bits from the storage unit, compares the current vertical polarity reversal control signal from the most significant bit extractor with the previous vertical polarity reversal control signal from the storage unit, and determines a logic value of the preparatory charging control signal based on results of the comparisons.

The m current pixels include 1st and 2nd current red pixels for displaying a red image, 1st and 2nd current green pixels for displaying a green image, and 1st and 2nd current blue pixels for displaying a blue image, the 1st current red pixel, the 1st current green pixel, and the 1st current blue pixel constitute a 1st current unit pixel for displaying one unit image, the 2nd current red pixel, the 2nd current green pixel, and the 2nd current blue pixel constitute a 2nd current unit pixel for displaying one unit image, the m previous pixels include 1st and 2nd previous red pixels for displaying a red image, 1st and 2nd previous green pixels for displaying a green image, and 1st and 2nd previous blue pixels for displaying a blue image, the 1st previous red pixel, the 1st previous green pixel, and the 1st previous blue pixel constitute a 1st previous unit pixel for displaying one unit image, the 2nd previous red pixel, the 2nd previous green pixel, and the 2nd previous blue pixel constitute a 2nd previous unit pixel for displaying one unit image, the current image data include 1st current red data that is to be provided to the 1st current red pixel, 1st current green data that is to be provided to the 1st current green pixel, 1st current blue data that is to be provided to the 1st current blue pixel, 2nd current red data that is to be provided to the 2nd current red pixel, 2nd current green data that is to be provided to the 2nd current green pixel, 2nd current blue data that is to be provided to the 2nd current blue pixel, and the previous image data include 1st previous red data that is to be provided to the 1st previous red pixel, 1st previous green data that is to be provided to the 1st previous green pixel, 1st previous blue data that is to be provided to the 1st previous blue pixel, 2nd previous red data that is to be provided to the 2nd previous red pixel, 2nd previous green data that is to be provided to the 2nd previous green pixel, 2nd previous blue data that is to be provided to the 2nd previous blue pixel.

The most significant bit extractor extracts 1st current red most significant bits corresponding to k most significant bits from the 1st current red data, the most significant bit extractor extracts 1st current green most significant bits corresponding to k most significant bits from the 1st current green data, the most significant bit extractor extracts 1st current blue most significant bits corresponding to k most significant bits from the 1st current blue data, the most significant bit extractor extracts 2nd current red most significant bits corresponding to k most significant bits from the 2nd current red data, the most significant bit extractor extracts 2nd current green most significant bits corresponding to k most significant bits from the 2nd current green data, the most significant bit extractor extracts 2nd current blue most significant bits corresponding to k most significant bits from the 2nd current blue data, and the most significant bit extractor synchronizes and provides the 1st current red most significant bits, the 1st current green most significant bits, the 1st current blue most significant bits, the 2nd current red most significant bits, the 2nd current green most significant bits, the 2nd current blue most significant bits, and the current vertical polarity reversal control signal to the storage unit and the preparatory charging determinator.

1st previous red most significant bits corresponding to k most significant bits of the 1st previous red data, 1st previous green most significant bits corresponding to k most significant bits of the 1st previous green data, 1st previous blue most significant bits corresponding to k most significant bits of the 1st previous blue data, 2nd previous red most significant bits corresponding to k most significant bits of the 2nd previous red data, 2nd previous green most significant bits corresponding to k most significant bits of the 2nd previous green data, 2nd previous blue most significant bits corresponding to k most significant bits of the 2nd previous blue data, and the previous vertical polarity reversal control signal have already been stored in the storage unit, and the 1st previous red most significant bits, the 1st previous green most significant bits, the 1st previous blue most significant bits, the 2nd previous red most significant bits, the 2nd previous green most significant bits, the 2nd previous blue most significant bits, and the previous vertical polarity reversal control signal have been received from the most significant bit extractor.

The preparatory charging determinator includes a 1st comparator that compares the current vertical polarity reversal control signal from the most significant bit extractor and the previous vertical polarity reversal control signal from the storage unit, compares the 1st current red most significant bits from the most significant bit extractor and the 1st previous red most significant bits from the storage unit, and sets a logic value of a 1st comparison signal according to results of the comparisons, a 2nd comparator that compares the current vertical polarity reversal control signal from the most significant bit extractor and the previous vertical polarity reversal control signal from the storage unit, compares the 1st current green most significant bits from the most significant bit extractor and the 1st previous green most significant bits from the storage unit, and sets a logic value of a 2nd comparison signal according to results of the comparisons, a 3rd comparator that compares the current vertical polarity reversal control signal from the most significant bit extractor and the previous vertical polarity reversal control signal from the storage unit, compares the 1st current blue most significant bits from the most significant bit extractor and the 1st previous blue most significant bits from the storage unit, and sets a logic value of a 3rd comparison signal according to results of the comparisons, a 4th comparator that compares the current vertical polarity reversal control signal from the most significant bit extractor and the previous vertical polarity reversal control signal from the storage unit, compares the 2nd current red most significant bits from the most significant bit extractor and the 2nd previous red most significant bits from the storage unit, and sets a logic value of a 4th comparison signal according to results of the comparisons, a 5th comparator that compares the current vertical polarity reversal control signal from the most significant bit extractor and the previous vertical polarity reversal control signal from the storage unit, compares the 2nd current green most significant bits from the most significant bit extractor and the 2nd previous green most significant bits from the storage unit, and sets a logic value of a 5th comparison signal according to results of the comparisons, a 6th comparator that compares the current vertical polarity reversal control signal from the most significant bit extractor and the previous vertical polarity reversal control signal from the storage unit, compares the 2nd current blue most significant bits from the most significant bit extractor and the 2nd previous blue most significant bits from the storage unit, and sets a logic value of a 6th comparison signal according to results of the comparisons, and a preparatory charging decider that determines a logic value of the preparatory charging control signal based on the logic values of the 1st to 6th comparison signals from the 1st to 6th comparators.

Each of the comparators outputs a comparison signal having a high logic value regardless of a result of comparison between current most significant bits and previous most significant bits provided to the comparator when the current vertical polarity reversal control signal and the previous vertical polarity reversal control signal have different values.

Each of the comparators sets a logic value of a comparison signal that is to be output from the comparator based on a result of comparison between current most significant bits and previous most significant bits provided to the comparator when the current vertical polarity reversal control signal and the previous vertical polarity reversal control signal have the same value.

Each of the comparators outputs a comparison signal having a high logic value when a difference between levels of current most significant bits and previous most significant bits provided to the comparator is equal to or more than p levels, where p is a natural number and outputs a comparison signal having a low logic value when a difference between levels of current most significant bits and previous most significant bits provided to the comparator is less than p levels.

The preparatory charging decider determines the number of comparison signals having a high logic value provided from the 1st to 6th comparators and sets the logic value of the preparatory charging control signal to a high logic value when the number of the comparison signals having a high logic value is equal to or greater than q, where q is a natural number, and sets the logic value of the preparatory charging control signal to a low logic value when the number of the comparison signals having a high logic value is less than q.

The liquid crystal display device may further include a synchronization unit that generates 1st and 2nd preparatory charging control data in response to a preparatory charging control signal from the preparatory charging controller, sets logic values of the 1st and 2nd preparatory charging control data according to a logic value of the preparatory charging control signal, synchronizes the 1st and 2nd preparatory charging control data and current image data, a current vertical polarity reversal control signal, and a current horizontal polarity reversal control signal from the timing controller, and rearranges and outputs the synchronized 1st and 2nd preparatory charging control data, current image data, current vertical polarity reversal control signal, and current horizontal polarity reversal control signal according to a data map of the data driver, and an interface unit that transmits the synchronized 1st and 2nd preparatory charging control data, the current image data, the current vertical polarity reversal control signal, and the current horizontal polarity reversal control signal from the synchronization unit to the data driver, wherein the current horizontal polarity reversal control signal is a signal for controlling polarities of current image data in a horizontal direction.

In another aspect of the present invention, a method for driving a liquid crystal display device includes a 1st process including receiving current image data that are to be provided to m current pixels among a plurality of pixels located at an nth horizontal line and a current vertical polarity reversal control signal for controlling polarities of the current image data in a vertical direction, a 2nd process including comparing the current image data with previous image data that have been provided to m previous pixels corresponding to the current m pixels among a plurality of pixels located at an n−1th horizontal line, a 3rd process including comparing the current vertical polarity reversal control signal with a previous vertical polarity reversal control signal for controlling polarities of the previous image data in a vertical direction, a 4th process including determining a logic value of a preparatory charging control signal based on results of the 2nd and 3rd processes, and a 5th process including performing one of a first operation, in which m data lines connected respectively to the m current pixels are connected to each other and the m data lines are again separated from each other, and a second operation, in which the m data lines are kept separate from each other, according to the logic value of the preparatory charging control signal and then providing the current image data to the m pixels.

The 2nd process includes comparing k most significant bits of the current image data and k most significant bits of the previous image data.

The 1st to 4th processes include receiving current image data and a current vertical polarity reversal control signal and extracting current most significant bits corresponding to k most significant bits from the current image data, reading a previous vertical polarity reversal control signal and previous most significant bits corresponding to k most significant bits of the previous image data from a storage unit, storing the current most significant bits and the current vertical polarity reversal control signal in the storage unit, and comparing the current most significant bits with the previous most significant bits from the storage unit, comparing the current vertical polarity reversal control signal with the previous vertical polarity reversal control signal from the storage unit, and determining a logic value of the preparatory charging control signal based on results of the comparisons.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
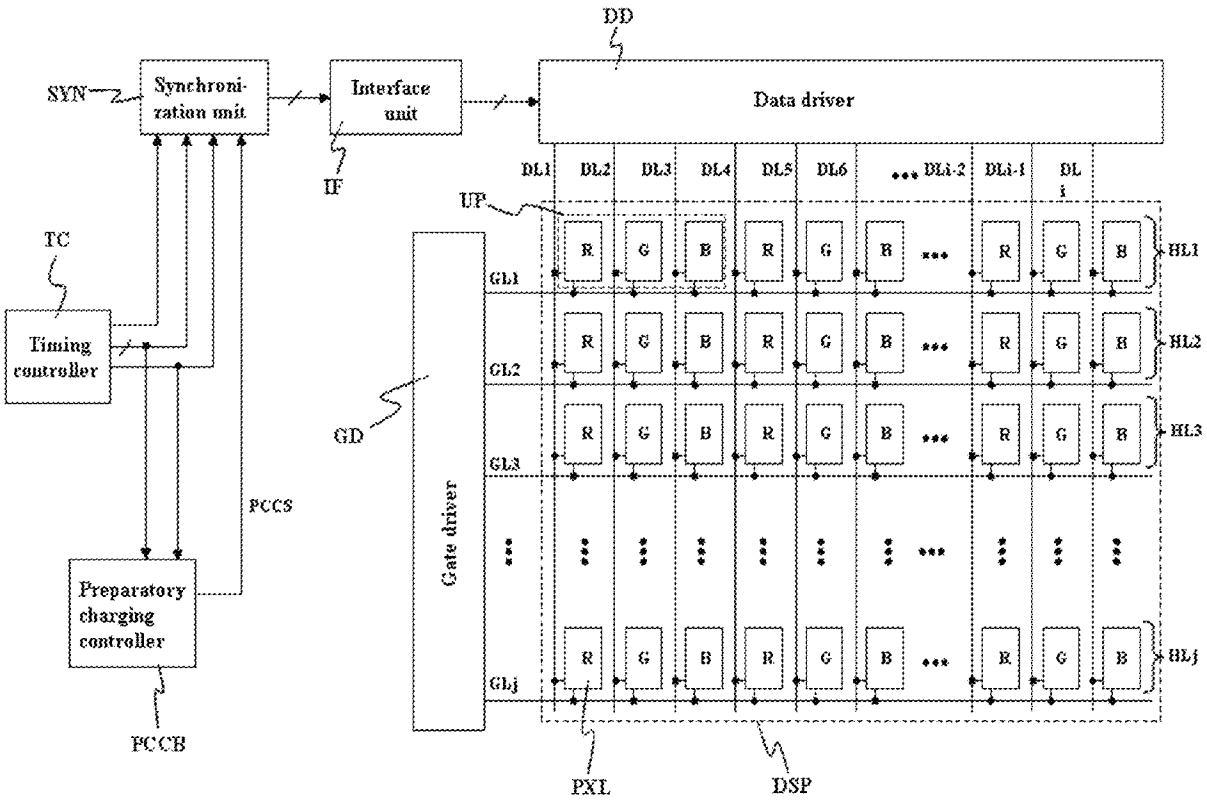
FIG. 1 illustrates a display device according to an embodiment of the present invention.

FIG. 1 illustrates a display device according to an embodiment of the present invention.

As shown in FIG. 1, the display device according to the present invention includes a display portion DSP, a data driver DD, a gate driver GD, a timing controller TC, a preparatory charging controller PCCB, a synchronization unit SYN, and an interface unit IF.

The display portion DSP includes pixels PXL, a plurality of gate lines GL1 to GLj for transmitting various signals required for the pixels PXL to display images, and a plurality of data lines DL1 to DLi.

The pixels PXL are arranged on the display portion DSP in a matrix form. i pixels PXL are arranged on each of the horizontal lines HL1 to HLj. The pixels PXL are divided into red pixels R for displaying red, green pixels G for displaying green, and blue pixels B for displaying blue. Here, three pixels, a red pixel, a green pixel, and a blue pixel, which are connected to the same gate line and are located adjacent to each other, constitute a single unit pixel UP. The unit pixel UP displays a single unit image by mixing a red image, a green image, and a blue image.

The timing controller TC receives a horizontal synchronization signal, a vertical synchronization signal, a clock signal, and image data. The timing controller TC generates data control signals and gate control signals using the received horizontal synchronization signal, vertical synchronization signal, and clock signal. The data control signals include a dot clock, a source shift clock, a source enable signal, a vertical polarity reversal control signal, a horizontal polarity reversal control signal, and the like. The gate control signals include a gate start pulse, a gate shift clock, a gate output enable signal, and the like. The data control signals are provided to the data driver DD and the gate control signals are provided to the gate driver GD.

The preparatory charging controller PCCB receives current image data that are to be provided to m current pixels (m being a natural number) among a plurality of pixels located at the nth horizontal line (n being a natural number) and a current vertical polarity reversal control signal vPOL_n from the timing controller TC. Here, the vertical polarity reversal control signal vPOL_n is a signal for controlling the polarities of the current image data Data in the vertical direction.

Then, the preparatory charging controller PCCB compares the current image data Data with previous image data that have been provided to m previous pixels located at the n−1th horizontal line HLn−1. Here, the preparatory charging controller PCCB may compare k most significant bits (k: natural number) of the current image data Data with k most significant bits of the previous image data.

In addition, the preparatory charging controller PCCB compares the current vertical polarity reversal control signal vPOL_n with a previous vertical polarity reversal control signal vPOL_n−1. Here, the vertical polarity reversal control signal vPOL_n−1 is a signal for controlling the polarity of previous image data in the vertical direction.

Then, the preparatory charging controller PCCB determines the logic value of a preparatory charging control signal PCCS based on the compared results.

In the above manner, the preparatory charging controller PCCB divides i current image data that are to be provided to all of the i current pixels included in the nth horizontal line HLn into groups of m image data and sequentially analyzes the groups of m image data.

The synchronization unit SYN generates first and second preparatory charging control data in response to the preparatory charging control signal PCCS from the preparatory charging controller PCCB. The synchronization unit SYN setsthe logic values of the first and second preparatory charging control data according to the logic value of the preparatory charging control signal PCCS. Then, the synchronization unit SYN synchronizes the first and second preparatory charging control data and the current image data, the current vertical polarity reversal control signal vPOL_n, and the current horizontal polarity reversal control signal hPOL_n received from the timing controller TC and rearranges and outputs the synchronized first and second preparatory charging control data, the synchronized current image data, the synchronized current vertical polarity reversal control signal vPOL_n, and the synchronized current horizontal polarity reversal control signal hPOL_n according to a data map of the data driver DD.

The interface unit IF transmits the first and second preparatory charging control data, the current image data, the current vertical polarity reversal control signal vPOL_n, and the current horizontal polarity reversal control signal hPOL_n received from the synchronization unit SYN to the data driver DD. Here, the current horizontal polarity reversal control signal hPOL_n is a signal for controlling the polarities of the current image data in the horizontal direction.

The data driver DD performs one of a first operation and a second operation according to the logic value of the preparatory charging control signal PCCS provided from the preparatory charging controller PCCB through the interface unit IF and the synchronization unit SYN. That is, the data driver DD performs one of the first and second operations according to the logic value of the first and second preparatory charging control data from the interface unit IF. In details, when the logic values of both the first and second preparatory charging control data are high, the data driver DD performs the first operation in which the data driver DD connects all m data lines connected respectively to the m current pixels to each other and then separates the m data lines DL from each other. On the other hand, when the logic value of the first preparatory charging control data is high and the logic value of the second preparatory charging control data is low, the data driver DD performs the second operation in which the data driver DD keeps all the m data lines separated from each other. After performing one of the first and second operations, the data driver DD provides the current image data, provided from the timing controller TC through the interface unit IF and the synchronization unit SYN, to the current pixels through the m data lines.

The data driver DD includes a plurality of switching units to perform the first and second operations as described above. That is, the data driver DD includes i output channels for providing i image data to i data lines. Each of the switching units connects m output channels to each other, or disconnects m output channels from each other.

Figure 2:
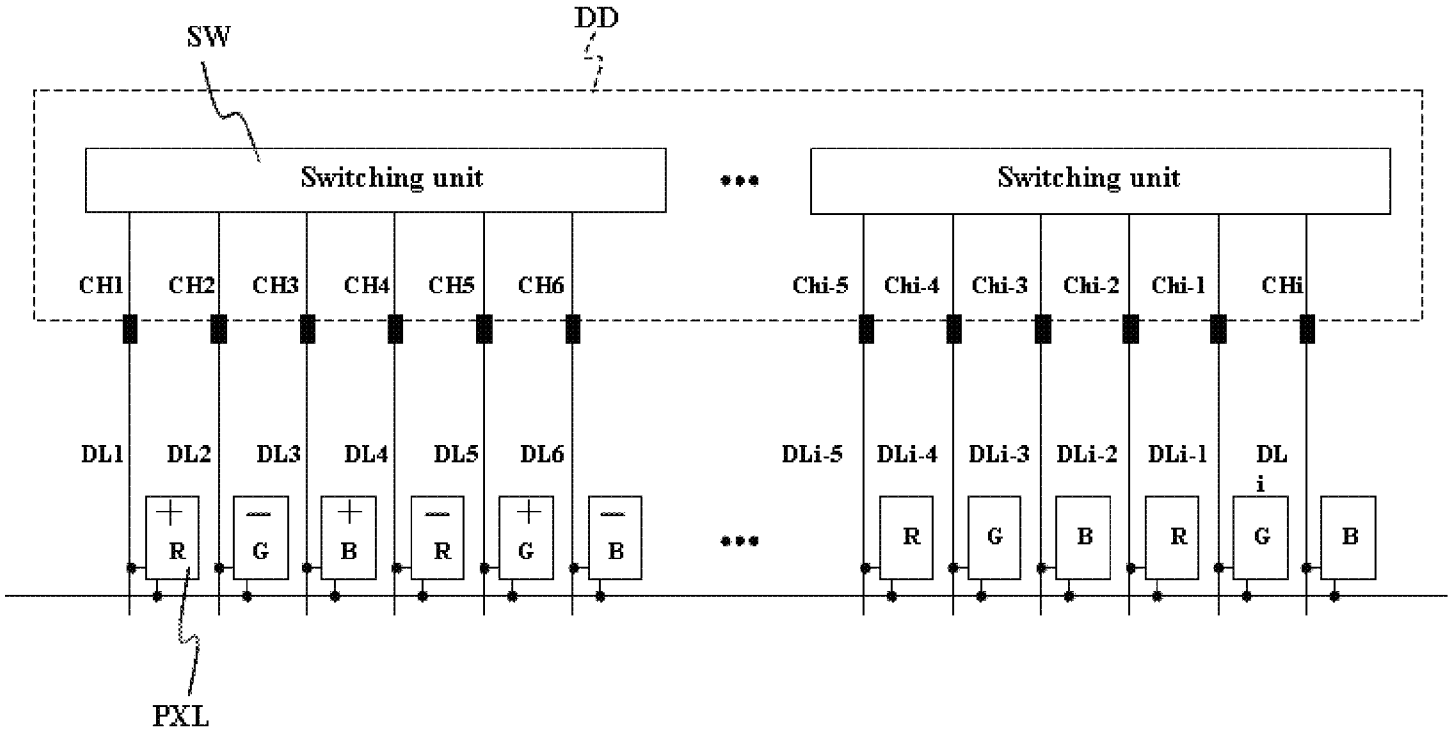
FIG. 2 illustrates how switching units provided in data driver DD operate.

FIG. 2 illustrates how the switching units provided in the data driver DD operate. For example, as shown in FIG. 2, 6 output channels CH1 to CH6 may be connected to each other or may be disconnected from each other through one switching unit SW. Here, if 6 output channels are all connected to each other through the switching unit, 6 data lines DL1 to DL6 corresponding to the 6 output channels are all connected to each other. This allows 6 previous image data that have been charged in the 6 data lines DL1 to DL6 to be mixed and averaged. The 6 previous image data are image data that have been provided to 6 previous pixels. Here, since the 6 previous image data that have been charged in the 6 previous pixels have different polarities, the averaged image data have a voltage close to the common voltage. For example, in the case where 1st to 6th previous image data have been charged in 1st to 6th previous pixels connected to the 1st to 6th data lines shown in FIG. 2, the 1st to 6th image data may sequentially have a positive polarity (+), a negative polarity (−), a positive polarity (+), a negative polarity (−), a positive polarity (+), and a negative polarity (−) or may sequentially have a positive polarity (+), a negative polarity (−), a negative polarity (−), a positive polarity (+), a positive polarity (+), and a negative polarity (−) or may sequentially have a positive polarity (+), a positive polarity (+), a negative polarity (−), a negative polarity (−), a positive polarity (+), and a positive polarity (+).

Thus, before providing m current image data to m data lines, the data driver DD determines whether to allow the m data lines to have averaged image data during a disable duration of a source enable signal or to the m data lines to continue to have m previous image data that have been provided to previous pixels. The data driver DD makes this determination based on the previous image data, the current image data, the previous vertical polarity reversal control signal vPOL_n−1, and the current vertical polarity reversal control signal vPOL_n as described above.

After making this determination, the data driver DD may provide m current image data corresponding to the m current pixels to the m data lines in a normal state in which the m output channels are separated from each other such that the m data lines are not connected to each other, thereby improving charge speed of the m data lines.

The operations of switching units SW are individually controlled. That is, one switching unit SW may be controlled to perform the first operation while another switching unit SW is controlled to perform the second operation. Accordingly, when m output channels of one switching unit SW are all connected to each other, m output channels of another switching unit SW may be kept separate from each other.

Figure 3:
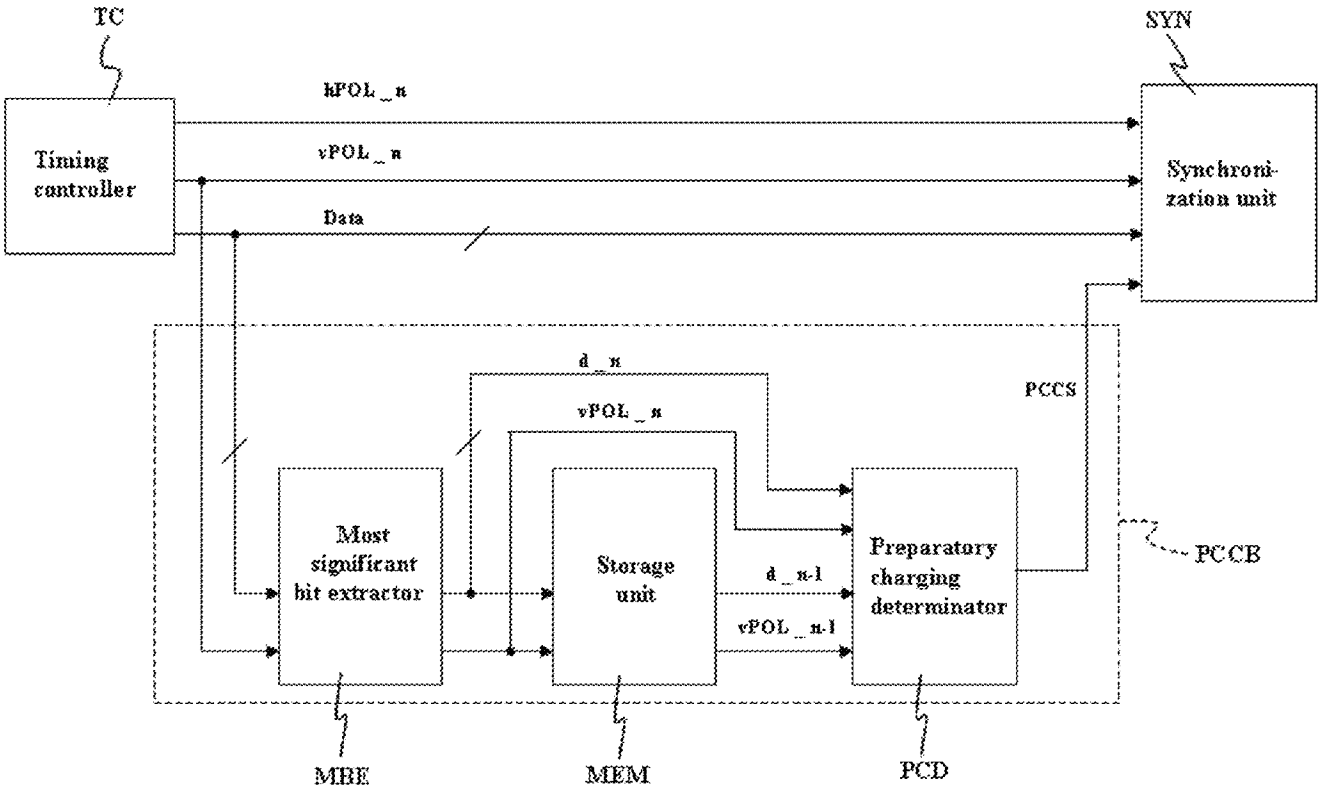
FIG. 3 illustrates a detailed configuration of preparatory charging controller PCCB of FIG. 1.

FIG. 3 illustrates a detailed configuration of the preparatory charging controller PCCB of FIG. 1.

The preparatory charging controller PCCB includes a most significant bit extractor MBE, a storage unit MEM, and a preparatory charging determinator PCD as shown in FIG. 3.

The most significant bit extractor MBE receives current image data and the current vertical polarity reversal control signal vPOL_n from the timing controller TC and extracts current most significant bits corresponding to k most significant bits from the current image data. Here, k is a natural number which may be, for example, 2.

The storage unit MEM stores the current most significant bits from the most significant bit extractor MBE and the current vertical polarity reversal control signal vPOL_n from the most significant bit extractor MBE. Here, a previous vertical polarity reversal control signal vPOL_n−1 and previous most significant bits corresponding to the k most significant bits of the previous image data have already been stored in the storage unit MEM.

The preparatory charging determinator PCD compares the current most significant bits from the most significant bit extractor MBE and the previous most significant bits from the storage unit MEM. The preparatory charging determinator PCD compares the current vertical polarity reversal control signal vPOL_n from the most significant bit extractor MBE and the previous vertical polarity reversal control signal vPOL_n−1 from the storage unit MEM. The preparatory charging determinator PCD then determines the logic value of the preparatory charging control signal PCCS based on the compared results and outputs the preparatory charging control signal PCCS having the determined logic value.

In the meantime, in the present invention, the value "m" may be defined as 6 such that 6 current image data that are to be provided to 6 current pixels can be analyzed. Here, the 6 current pixels constitute 2 unit pixels.

Figure 4:
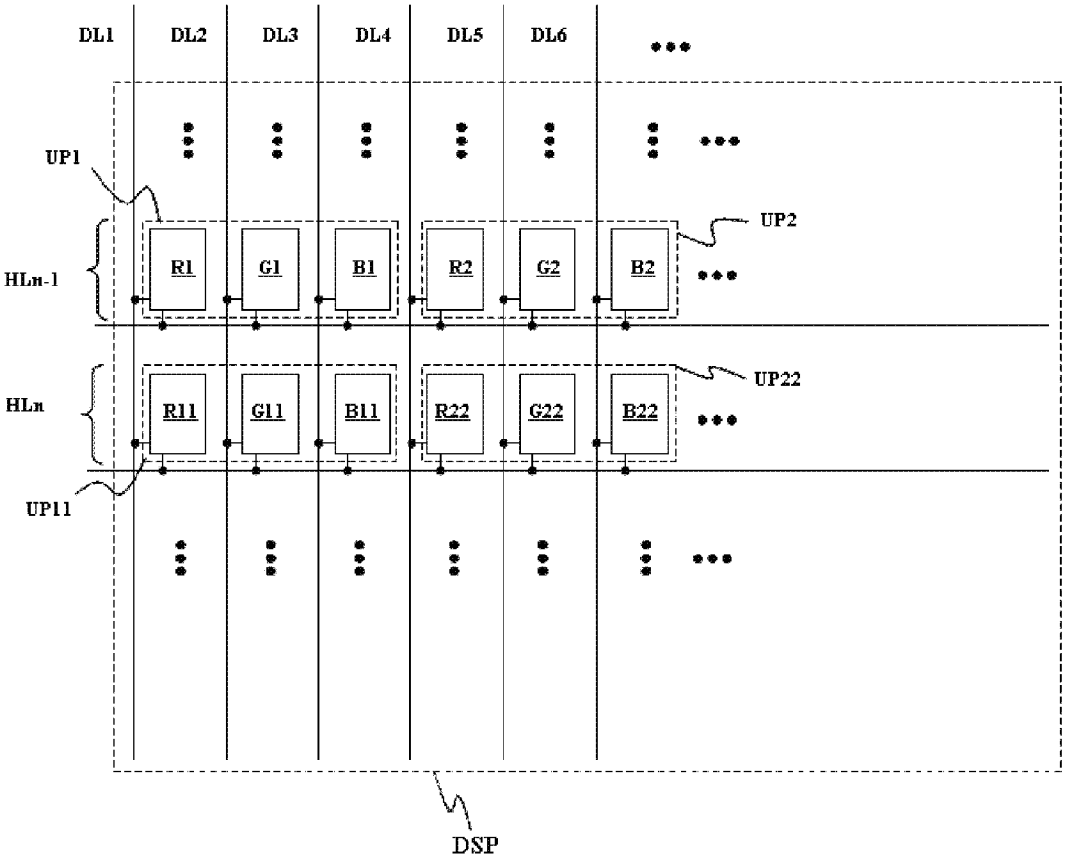
FIG. 4 illustrates 6 previous pixels located at an n−1th horizontal line and 6 current pixels located at an nth horizontal line among all pixels of FIG. 1.

FIG. 4 illustrates 6 previous pixels R1, G1, B1, R2, G2, and B2 located at the n−1th horizontal line HLn−1 and 6 current pixels R11, G11, B11, R22, G22, and B22 located at the nth horizontal line HLn among all pixels of FIG. 1.

As shown in FIG. 4, the 6 previous pixels R1, G1, B1, R2, G2, and B2 located at the n−1th horizontal line HLn−1 include 1st and 2nd previous red pixels R1 and R2 for displaying red images, 1st and 2nd previous green pixels G1 and G2 for displaying green images, and 1st and 2nd previous blue pixels B1 and B2 for displaying blue images. Here, the 1st previous red pixel R1, the 1st previous green pixel G1, and the 1st previous blue pixel B1 constitute a 1st previous unit pixel UP1 for displaying one unit image. The 2nd previous red pixel R2, the 2nd previous green pixel G2, and the 2nd previous blue pixel B2 constitute a 2nd previous unit pixel UP2 for displaying one unit image.

In addition, as shown in FIG. 4, the 6 current pixels R11, G11, B11, R22, G22, and B22 located at the nth horizontal line HLn include 1st and 2nd current red pixels R11 and R22 for displaying red images, 1st and 2nd current green pixels Gil and G22 for displaying green images, and 1st and 2nd current blue pixels B11 and B22 for displaying blue images. Here, the 1st current red pixel R11, the 1st current green pixel G11, and the 1st current blue pixel B11 constitute a 1st current unit pixel UP1 for displaying one unit image. The 2nd current red pixel R22, the 2nd current green pixel G22, and the 2nd current blue pixel B22 constitute a 2nd current unit pixel UP2 for displaying one unit image.

Here, image data provided to the pixels are classified as follows.

That is, the previous image data include 1st previous red data provided to the 1st previous red pixel R1, 1st previous green data provided to the 1st previous green pixel G1, 1st previous blue data provided to the 1st previous blue pixel B1, 2nd previous red data provided to the 2nd previous red pixel R2, 2nd previous green data provided to the 2nd previous green pixel G2, and 2nd previous blue data provided to the 2nd previous blue pixel B2.

In addition, the current image data Data include 1st current red data provided to the 1st current red pixel R11, 1st current green data provided to the 1st current green pixel G11, 1st current blue data provided to the 1st current blue pixel B11, 2nd current red data provided to the 2nd current red pixel R22, 2nd current green data provided to the 2nd current green pixel G22, and 2nd current blue data provided to the 2nd current blue pixel B22.

The following is a detailed description of operations of the most significant bit extractor MBE, the storage unit MEM, and the preparatory charging determinator PCD provided in the preparatory charging controller PCCB based on the pixels and the image data provided to the pixels shown in FIG. 4.

Figure 5:
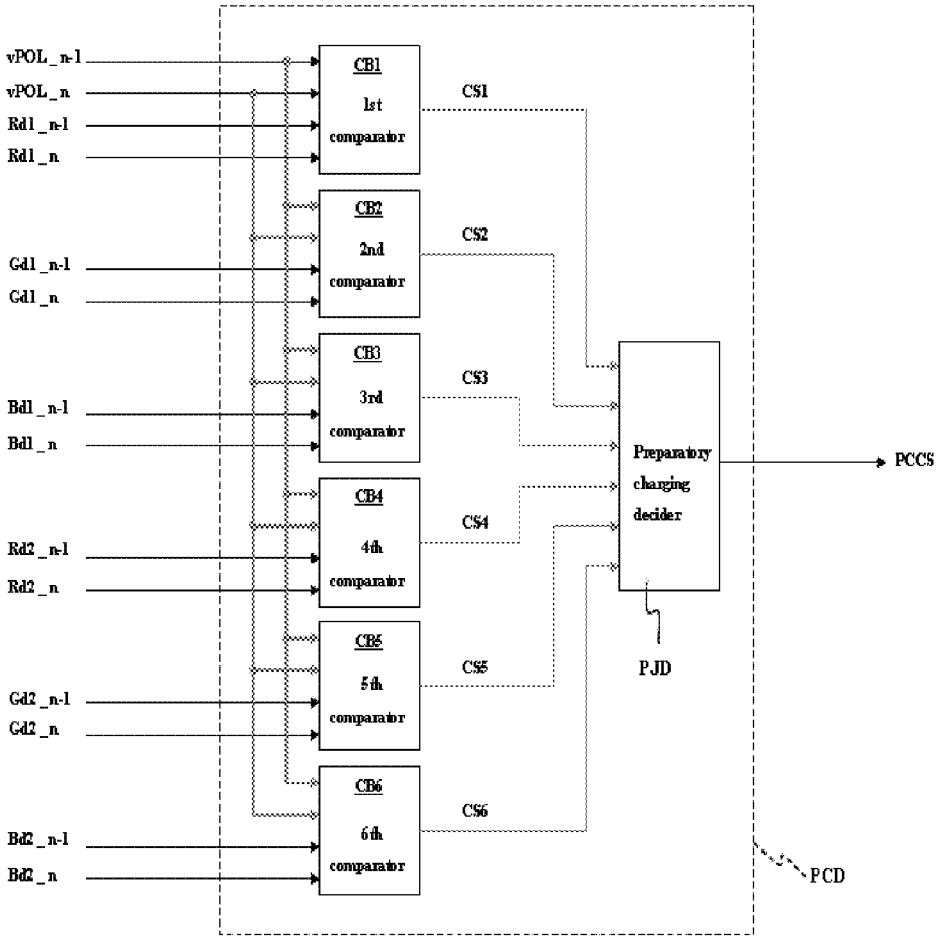
FIG. 5 illustrates a detailed configuration of the preparatory charging determinator of FIG. 3.

Referring to FIG. 5, the most significant bit extractor MBE extracts 1st current red most significant bits Rd1_n corresponding to k most significant bits from the 1st current red data. The most significant bit extractor MBE extracts 1st current green most significant bits Gd1_n corresponding to k most significant bits from the 1st current green data. The most significant bit extractor MBE extracts 1st current blue most significant bits Bd1_n corresponding to k most significant bits from the 1st current blue data. In addition, the most significant bit extractor MBE extracts 2nd current red most significant bits Rd2_n corresponding to k most significant bits from the 2nd current red data. The most significant bit extractor MBE extracts 2nd current green most significant bits Gd2_n corresponding to k most significant bits from the 2nd current green data. The most significant bit extractor MBE extracts 2nd current blue most significant bits Bd2_n corresponding to k most significant bits from the 2nd current blue data. In addition, the most significant bit extractor synchronizes the 1st current red most significant bits Rd1_n, the 1st current green most significant bits Gd1_n, the 1st current blue most significant bits Bd1_n, the 2nd current red most significant bits Rd2_n, the 2nd current green most significant bits Gd2_n, and the 2nd current blue most significant bits Bd2_n with the current vertical polarity reversal control signal vPOL_n and provides the synchronized bits and current vertical polarity reversal control signal vPOL_n to the storage unit MEM and the preparatory charging determinator PCD.

The storage unit MEM previously stores 1st previous red most significant bits Rd1_n−1 corresponding to k most significant bits of the 1st previous red data, 1st previous green most significant bits Gd1_n−1 corresponding to k most significant bits of the 1st previous green data, 1st previous blue most significant bits Bd1_n−1 corresponding to k most significant bits of the 1st previous blue data, 2nd previous red most significant bits Rd2_n−1 corresponding to k most significant bits of the 2nd previous red data, 2nd previous green most significant bits Gd2_n−1 corresponding to k most significant bits of the 2nd previous green data, 2nd previous blue most significant bits Bd2_n−1 corresponding to k most significant bits of the 2nd previous blue data, and the previous vertical polarity reversal control signal vPOL_n−1.

The 1st previous red most significant bits Rd1_n−1, the 1st previous green most significant bits Gd1_n−1, the 1st previous blue most significant bits Bd1_n−1, the 2nd previous red most significant bits Rd2_n−1, the 2nd previous green most significant bits Gd2_n−1, the 2nd previous blue most significant bits Bd2_n−1, and the previous vertical polarity reversal control signal vPOL_n−1 stored in the storage unit MEM have been received from the most significant bit extractor MBE described above.

The storage unit MEM stores image data corresponding to pixels of one horizontal line. However, as described above, the storage unit MEM stores k most significant bits of the image data of each pixel rather than all bits of the image data of each pixel.

For example, the amount of data to be stored in the storage unit MEM is calculated as follows when image data provided to each pixel is 10 bits and the k most significant bits are 2 bits in the case of a Full High Definition (FHD) display device having 1920 unit pixels per horizontal line.

storage unit MEM capacity=1920*1/2*(2 bit*6+1 bit)=12,480 bits

In this equation, 1 bit indicates the bit of the vertical polarity reversal control signal. The 1-bit vertical polarity reversal control signal is used to control the polarity of 6 image data. Thus, a 1-bit vertical polarity reversal control signal is required per 6 image data.

An SRAM (Static Random Access Memory) may be used for the storage unit MEM of the present invention.

FIG. 5 illustrates a detailed configuration of the preparatory charging determinator PCD of FIG. 3.

As shown in FIG. 5, the preparatory charging determinator PCD includes 1st to 6th comparators CB1 to CB6 and a preparatory charging decider PJD.

The 1st comparator CB1 compares the current vertical polarity reversal control signal vPOL_n from the most significant bit extractor MBE and the previous vertical polarity reversal control signal vPOL_n−1 from the storage unit MEM. The 1st comparator CB1 also compares the 1st current red most significant bits Rd1_n from the most significant bit extractor MBE and the 1st previous red most significant bits Rd1_n−1 from the storage unit MEM. The 1st comparator CB1 sets a logic value of a 1st comparison signal CS1 according to the comparison results and outputs the 1st comparison signal CS1 having the set logic value.

The 2nd comparator CB2 compares the current vertical polarity reversal control signal vPOL_n from the most significant bit extractor MBE and the previous vertical polarity reversal control signal vPOL_n−1 from the storage unit MEM. The 2nd comparator CB2 also compares the 1st current green most significant bits Gd1_n from the most significant bit extractor MBE and the 1st previous green most significant bits Gd1_n−1 from the storage unit MEM. The 2nd comparator CB2 sets a logic value of a 2nd comparison signal CS2 according to the comparison results and outputs the 2nd comparison signal CS2 having the set logic value.

The 3rd comparator CB3 compares the current vertical polarity reversal control signal vPOL_n from the most significant bit extractor MBE and the previous vertical polarity reversal control signal vPOL_n−1 from the storage unit MEM. The 3rd comparator CB3 also compares the 1st current blue most significant bits Bd1_n from the most significant bit extractor MBE and the 1st previous blue most significant bits Bd1_n−1 from the storage unit MEM. The 3rd comparator CB3 sets a logic value of a 3rd comparison signal CS3 according to the comparison results and outputs the 3rd comparison signal CS3 having the set logic value.

The 4th comparator CB4 compares the current vertical polarity reversal control signal vPOL_n from the most significant bit extractor MBE and the previous vertical polarity reversal control signal vPOL_n−1 from the storage unit MEM. The 4th comparator CB4 also compares the 2nd current red most significant bits Rd2_n from the most significant bit extractor MBE and the 2nd previous red most significant bits Rd2_n−1 from the storage unit MEM. The 4th comparator CB4 sets a logic value of a 4th comparison signal CS4 according to the comparison results and outputs the 4th comparison signal CS4 having the set logic value.

The 5th comparator CB5 compares the current vertical polarity reversal control signal vPOL_n from the most significant bit extractor MBE and the previous vertical polarity reversal control signal vPOL_n−1 from the storage unit MEM. The 5th comparator CB5 also compares the 2nd current green most significant bits Gd2_n from the most significant bit extractor MBE and the 2nd previous green most significant bits Gd2_n−1 from the storage unit MEM. The 5th comparator CB5 sets a logic value of a 5th comparison signal CS5 according to the comparison results and outputs the 5th comparison signal CS5 having the set logic value.

The 6th comparator CB6 compares the current vertical polarity reversal control signal vPOL_n from the most significant bit extractor MBE and the previous vertical polarity reversal control signal vPOL_n−1 from the storage unit MEM. The 6th comparator CB6 also compares the 2nd current blue most significant bits Bd2_n from the most significant bit extractor MBE and the 2nd previous blue most significant bits Bd2_n−1 from the storage unit MEM. The 6th comparator CB6 sets a logic value of a 6th comparison signal CS6 according to the comparison results and outputs the 6th comparison signal CS6 having the set logic value.

The preparatory charging decider PJD determines the logic value of the preparatory charging control signal PCCS based on the logic values of the 1st to 6th comparison signals CS1 to CS6 and outputs the preparatory charging control signal PCCS having the determined logic value.

When the current vertical polarity reversal control signal vPOL_n and the previous vertical polarity reversal control signal vPOL_n−1 have different values, each comparator CB1 to CB6 outputs a comparison signal having a high logic value regardless of the comparison results between the previous most significant bits and the current most significant bits provided to the comparator. For example, in the example of FIG. 5, the 1st to 6th comparators output 1st to 6th comparison signals CS1 to CS6 having high logic values when the previous vertical polarity reversal control signal vPOL_n−1 has a high logic value and the current vertical polarity reversal control signal vPOL_n has a low logic value.

However, when the current vertical polarity reversal control signal vPOL_n and the previous vertical polarity reversal control signal vPOL_n−1 have the same value, each comparator CB1 to CB6 sets a logic value of a comparison signal, which is to be output from the comparator, based on the results of comparison between the previous most significant bits and the current most significant bits provided to the comparator. For example, in the example of FIG. 5, when both the previous vertical polarity reversal control signal vPOL_n−1 and the current vertical polarity reversal control signal vPOL_n have a high logic value, each of the 1st to 6th comparators compares the values of previous most significant bits and the values of the current most significant bits and sets a logic value of a comparison signal, which is to be output from the comparator, based on the differences between the values of the previous most significant bits and the current most significant bits.

When the most significant bits are 2 bits, the image data is classified as one of 4 levels. For example, if the current image data is 10 bits, the most significant bits of the current image data may be one of 00, 01, 10, and 11. Here, the 10-bit current image data is classified as 1st level data when the current image data is one of 0000000000 to 0011111111 (0th to 255th gray levels), and the 10-bit current image data is classified as 2nd level data when the current image data is one of 0100000000 to 0111111111 (256th to 511th gray levels), and the 10-bit current image data is classified as 3rd level data when the current image data is one of 1000000000 to 1011111111 (512th to 767th gray levels), and the 10-bit current image data is classified as 4th level data when the current image data is one of 1100000000 to 1111111111 (768th to 1023rd gray levels).

Accordingly, each comparator compares the levels of pairs of 2 most significant bits provided to the comparator to calculate the difference between the levels. For example, when both the previous vertical polarity reversal control signal vPOL_n−1 and the current vertical polarity reversal control signal vPOL_n have a high logic value and "00" is input as the value of the 1st previous red most significant bits Rd1_n−1 and "10" is input as the value of the 1st current red most significant bits Rd1_n to the 1st comparator as described above, the 1st comparator calculates 2 as the difference between the levels of the pair of the 2 most significant bits. The comparator then sets the logic value of the 1st comparison signal CS1 according to the calculated difference. For example, in the case where the 1st comparator CB1 outputs a comparison signal having a high logic value when the difference between the levels of the current most significant bits and the previous most significant bits provided to the 1st comparator CB1 is equal to or greater than 3 levels and outputs a comparison signal having a low logic value when the difference is less than 3 levels, the 1st comparator CB1 outputs the 1st comparison signal CS1 having a low logic value when the level difference is calculated as 2 as described above.

In this manner, each of the other 2nd to 6th comparators CB2 to CB6 compares the level difference between the previous most significant bits and the current most significant bits input to the comparator and sets a logic value of a comparison signal according to the comparison result and outputs the comparison signal having the set logic value.

The preparatory charging decider PJD outputs a preparatory charging control signal PCCS having a high logic value when the number of comparison signals having a high logic value among the 1st to 6th comparison signals CS1 to CS6 provided from the 1st to 6th comparators CB1 to CB6 is 4 or greater, while the preparatory charging decider PJD outputs a preparatory charging control signal PCCS having a low logic value when the number of comparison signals having a high logic value is less than 4.

The preparatory charging control signal PCCS output from the preparatory charging decider PJD is provided to the synchronization unit SYN.

The synchronization unit SYN generates 1st and 2nd preparatory charging control data in response to the preparatory charging control signal PCCS from the preparatory charging controller PCCB. Then the synchronization unit SYN sets the logic values of the 1st and 2nd preparatory charging control data according to the logic value of the preparatory charging control signal PCCS. The synchronization unit SYN then synchronizes the 1st and 2nd preparatory charging control data and the current image data, the current vertical polarity reversal control signal vPOL_n, and the current horizontal polarity reversal control signal received from the timing controller TC, and rearranges and outputs the synchronized 1st and 2nd preparatory charging control data, current image data, current vertical polarity reversal control signal vPOL_n, and current horizontal polarity reversal control signal according to the data map of the data driver DD.

The interface unit IF transmits the 1st and 2nd preparatory charging control data, the current image data, the current vertical polarity reversal control signal vPOL_n, and the current horizontal polarity reversal control signal received from the synchronization unit SYN to the data driver DD. Here, the horizontal polarity reversal control signal is a signal for controlling the polarities of the current image data in the horizontal direction.

The interface unit IF includes a mini-LVDS (Low Voltage Differential SignalingLVDS) transmitter and a mini-LVDS receiver.

Figure 6:
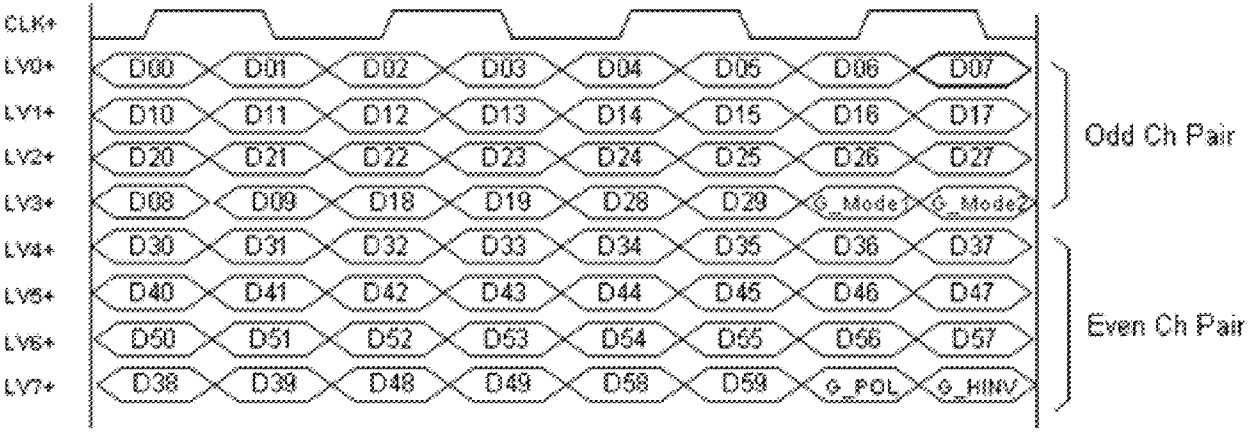
FIG. 6 illustrates data output from a mini-LVDS transmitter.

FIG. 6 illustrates data output from the mini-LVDS transmitter.

The mini-LVDS transmitter transmits a single data through each pair of low voltage differential lines. FIG. 6 illustrates a structure in which 8 pairs of low voltage differential lines (a total of 16 low voltage differential lines) LV0+ to LV7+ transmit 8 data in parallel.

That is, in the structure of FIG. 6, 1st 10-bit current red data D00 to D09, 1st 10-bit current green data D12 to D19, 1st 10-bit current blue data D20 to D29, 2nd 10-bit current red data D30 to D39, 2nd 10-bit current green data D40 to D49, 2nd 10-bit current blue data D50 to D59, 1st 1-bit preparatory charging control data G_Mode1, 2nd 1-bit preparatory charging control data G_Mode2, a current 1-bit vertical polarity reversal control signal vPOL_n, and a current 1-bit horizontal polarity reversal control signal G_HIVN are provided to the mini-LVDS receiver through the 8 pairs of low voltage differential lines LV0+ to LV7+.

Here, in the case where the mini-LVDS transmitter having the 8-pair structure is used, 64-bit data can be transmitted. 2 bits among the 64 bits are idle bits. In the present invention, the 2 idle bits are used to transmit the 1st and 2nd preparatory charging control data G_Mode1 and G_Mode2.

Here, as shown in FIG. 6, when both the 1st and 2nd preparatory charging control data G_Mode1 and G_Mode2 have a low logic value, the data driver DD performs a charge share operation. This charge share operation is the first operation described above. On the other hand, when the 1st preparatory charging control data G_Mode1 has a high logic value and the 2nd preparatory charging control data G_Mode2 has a low logic value, the data driver DD performs a Hi-z operation instead of the charge share operation. The Hi-z operation is the second operation described above.

Figure 7:
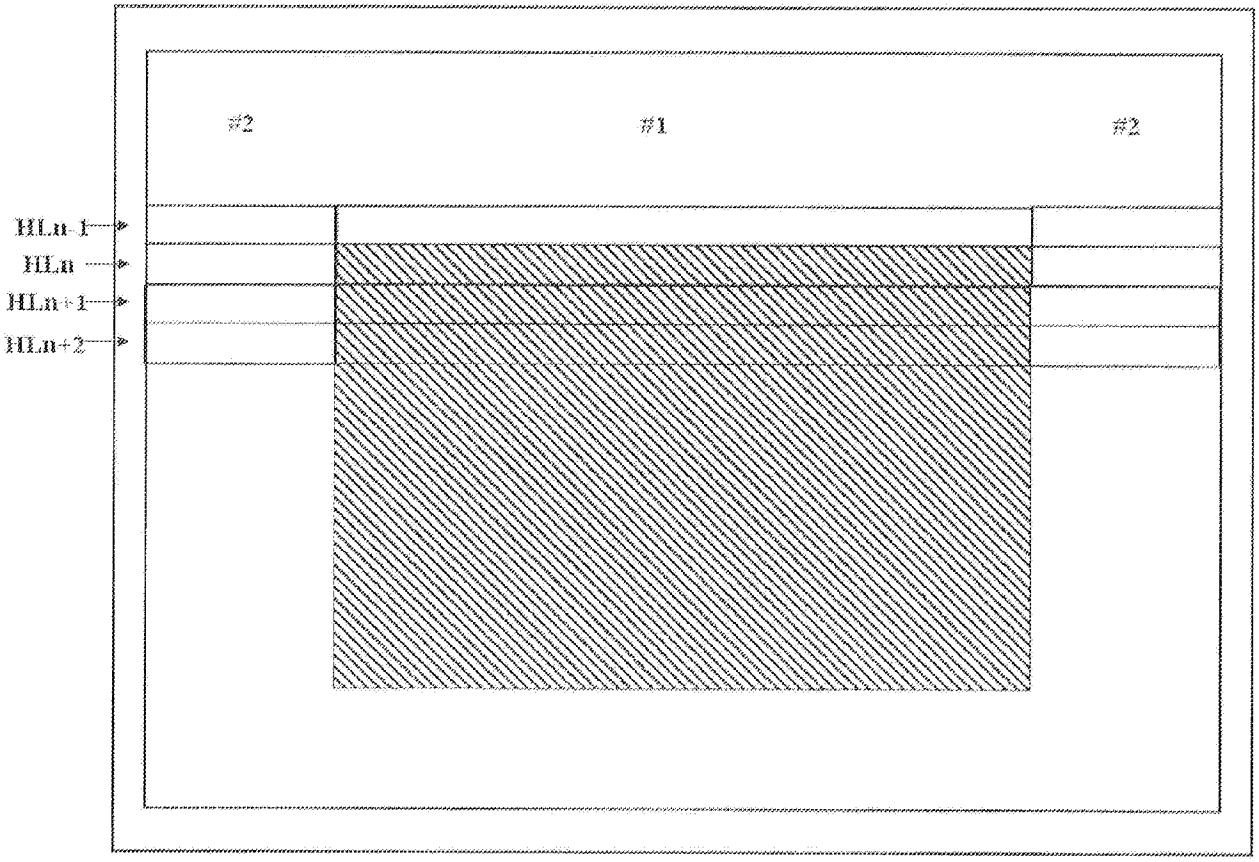
FIGS. 7 to 9 illustrate operations of a display device according to the present invention.
Figure 8:
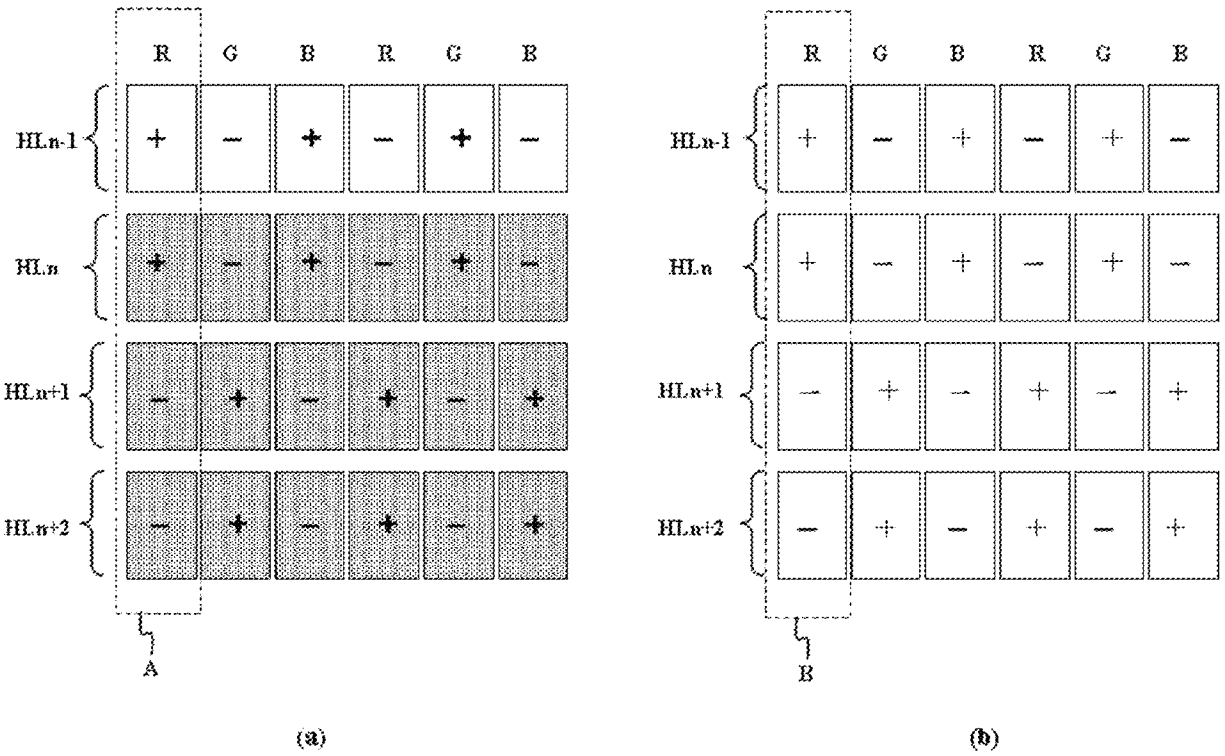
Figure 9:
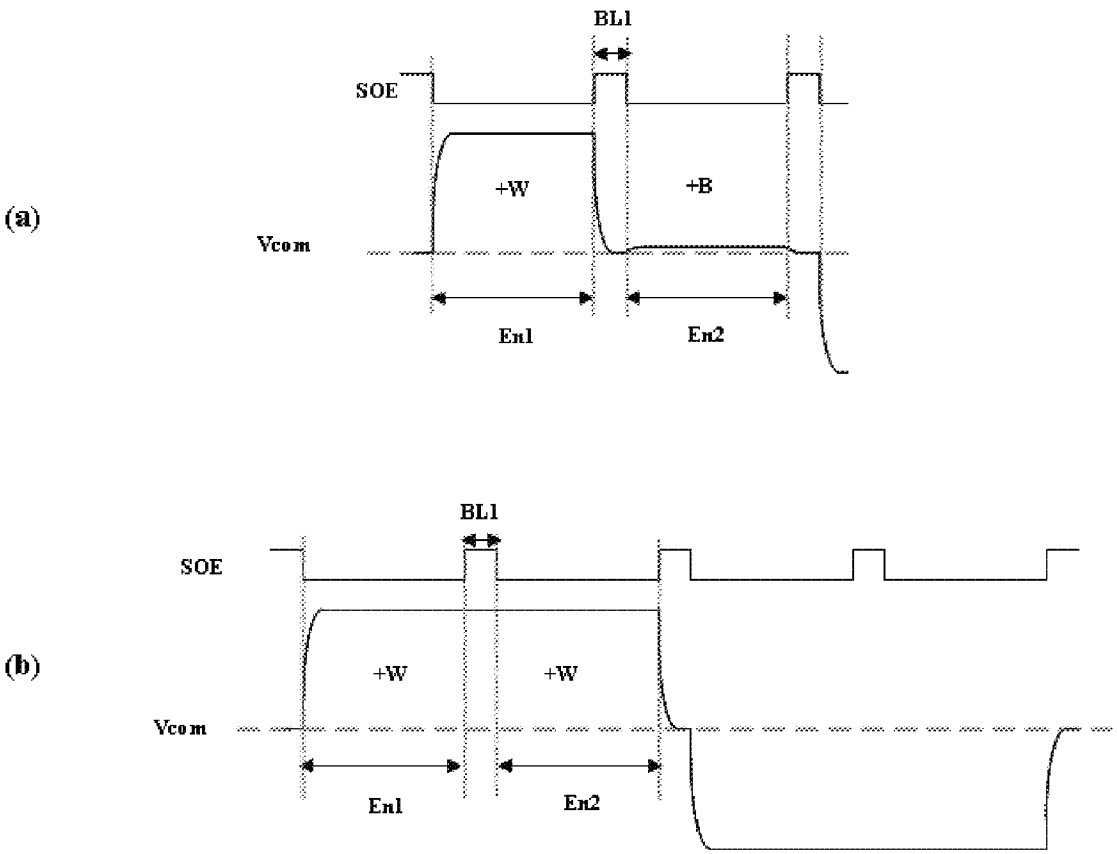

FIGS. 7 to 9 illustrate operations of a display device according to the present invention.

As shown in FIG. 7, a black image is displayed in a rectangular form at a central portion of the display portion DSP and a white image is displayed around the central portion.

In the case of an image of a 1st region #1, pixels included in an n−1th horizontal line HLn−1 among 4 arbitrary consecutive horizontal lines HLn−1 to HLn+2 display a white image and pixels included in 3 consecutive horizontal lines subsequent to the n−1th horizontal line HLn−1 display a black image.

On the other hand, in the case of an image of a 2nd region #2, all pixels included in 4 arbitrary consecutive horizontal lines HLn−1 to HLn+2 display a black image.

FIG. 8(*a*) illustrates the polarities of image data provided to pixels located at the 1st region #1 of FIG. 7 and FIG. 8(*b*) illustrates the polarities of image data provided to pixels located at the 2nd region #2 of FIG. 7.

As shown in FIG. 8, the polarities of the pixels are reversed in a horizontal direction in a 1-dot reversal manner and are reversed in a vertical direction in a 2-dot reversal manner. That is, a positive polarity and a negative polarity are alternately shown in the horizontal direction and 2 positive polarities and 2 negative polarities are alternately shown in the vertical direction.

Operations of pixels (A, B) arranged along the 1st horizontal line are described below.

First, in FIGS. 8(*a*) and (*b*), a pixel located at the n−1th horizontal line HLn−1 in the 1st vertical line is defined as a 1st pixel, a pixel located at the nth horizontal line HLn in the 1st vertical line is defined as a 2nd pixel, a pixel located at the n+1th horizontal line HLn+1 in the 1st vertical line is defined as a 3rd pixel, and a pixel located at the n+2th horizontal line HLn+2 in the 1st vertical line is defined as a 4th pixel.

As shown in FIG. 8(*a*), the 1st pixel receives image data corresponding to positive white and the 2nd pixel receives image data corresponding to positive black. That is, it can be seen from FIG. 8(*a*) that the 1st and 2nd pixels have the same polarity. Here, it can also be seen that a previous vertical polarity reversal control signal that has been provided to the 1st pixel and a current vertical polarity reversal control signal that will be provided to the 2nd pixel have the same value when the 1st pixel is a previous pixel and the 2nd pixel is a current pixel. Accordingly, the level of 1st previous red most significant bits Rd1_n−1 of 1st previous red data provided to the 1st pixel and the level of 1st current red most significant bits Rd1_n of 1st current red data provided to the 2nd pixel are compared, and one of the first and second operations is selected according to the comparison result. Here, the difference between the level of the 1st previous red most significant bits Rd1_n−1 and the level of the 1st current red most significant bits Rd1_n is 3 levels since the 1st previous red data provided to the 1st pixel has a logic value of 11 corresponding to the 4th level and the 1st current red data that will be provided to the 2nd pixel has a logic value of 00 corresponding to the 1st level. Accordingly, a data line connected to the 2nd pixel is connected to the 5 remaining data lines before the 1st current red data is provided to the data line. That is, 1 output channel corresponding to the data line of the 2nd pixel and the other remaining 5 output channels corresponding to the 5 data lines are connected to each other.

FIG. 9(*a*) corresponds to FIG. 8(*a*). As can be seen from FIG. 9(*a*), after 1st previous red data corresponding to the positive white +W is applied to an output channel during a 1st enable period En 1 of a source output enable signal SOE, 6 output channels are connected to each other during a 1st blank period BL1 of the source output enable signal SOE such that the 1st previous red data drops to the level of the common voltage Vcom. Thereafter, the connection of the output channels is released and 1st current red data corresponding to the positive black +B is applied to the output channel during a 2nd enable period En2 of the source output enable signal SOE. This increases the charge speed of the output channels and the data lines connected to the output channels.

The 2nd pixel receives image data corresponding to the positive black +B and the 3rd pixel receives image data corresponding to the negative black −B. That is, the polarity of the 2nd pixel is different from the polarity of the 3rd pixel. Thus, it can be seen that a previous vertical polarity reversal control signal vPOL_n−1 that has been provided to the 2nd pixel and a current vertical polarity reversal control signal vPOL_n that will be provided to the 3rd pixel have different values if the 2nd pixel is the previous pixel and the 3rd pixel is the current pixel. Accordingly, the data driver DD performs the first operation described above before providing the 1st current red data to the data line connected to the 3rd pixel.

On the other hand, the 3rd and 4th pixels have the same polarity since the 3rd pixel receives image data corresponding to the negative black −B and the 4th pixel receives image data corresponding to the positive black +B. Thus, it can be seen that a previous vertical polarity reversal control signal vPOL_n−1 that has been provided to the 3rd pixel and a current vertical polarity reversal control signal vPOL_n that will be provided to the 4th pixel have the same value if the 3rd pixel is the previous pixel and the 4th pixel is the current pixel. Here, the difference between the level of the 1st previous red data that has been provided to the 3rd pixel and the level of the 1st current red data that will be provided to the 4th pixel is 0 since both the 1st previous red data and the 1st current red data have the 1st level corresponding to black. Accordingly, the data driver DD performs the second operation described above before providing the 1st current red data to the data line connected to the 4th pixel. That is, the data driver DD provides corresponding current data to the 6 data lines connected to the 6 output channels after keeping the 6 output channels disconnected from each other.

As shown in FIG. 8(*b*), the 1st pixel receives image data corresponding to positive white +W and the 2nd pixel also receives image data corresponding to positive white +W. That is, it can be seen from FIG. 8(*b*) that the 1st and 2nd pixels have the same polarity, and the most significant bits of the 1st and 2nd pixels also have the same level. Here, it can also be seen that a previous vertical polarity reversal control signal that has been provided to the 1st pixel and a current vertical polarity reversal control signal that will be provided to the 2nd pixel have the same value when the 1st pixel is a previous pixel and the 2nd pixel is a current pixel. Accordingly, the level of 1st previous red most significant bits Rd1_n−1 of 1st previous red data provided to the 1st pixel and the level of 1st current red most significant bits Rd1_n of 1st current red data provided to the 2nd pixel are compared, and one of the first and second operations is selected according to the comparison result. Here, the difference between the level of the 1st previous red most significant bits Rd1_n−1 of the 1st previous red data and the level of the 1st current red most significant bits Rd1_n of the 1st current red data is 0 since the 1st previous red data provided to the 1st pixel has a logic value of 11 corresponding to the 4th level and the 1st current red data that will be provided to the 2nd pixel has a logic value of 11 corresponding to the 4th level. Accordingly, a data line connected to the 2nd pixel is maintained in a normal state in which the data line is separated from the 5 remaining data lines before the 1st current red data is provided to the data line. That is, output channels corresponding to the data line of the 2nd pixel and 5 output channels corresponding to the 5 data lines are kept separate from each other.

FIG. 9(*b*) corresponds to FIG. 8(*b*). As can be seen from FIG. 9(*b*), after 1st previous red data corresponding to the positive white is applied to an output channel during a 1st enable period En1 of a source output enable signal SOE, 6 output channels are in a normal state in which the 6 output channels are separated from each other during a 1st blank period BL1 of the source output enable signal SOE such that the level of the 1st previous red data is maintained without change. Thereafter, 1st current red data corresponding to the positive black is applied to the output channels during a 2nd enable period En2 of the source output enable signal SOE. This increases the charge speed of the output channels and the data lines connected to the output channels.

The 2nd pixel receives image data corresponding to the positive white +W and the 3rd pixel receives image data corresponding to the negative white. That is, the polarity of the 2nd pixel is different from the polarity of the 3rd pixel. Thus, it can be seen that a previous vertical polarity reversal control signal vPOL_n−1 that has been provided to the 2nd pixel and a current vertical polarity reversal control signal vPOL_n that will be provided to the 3rd pixel have different values if the 2nd pixel is the previous pixel and the 3rd pixel is the current pixel. Accordingly, the data driver DD performs the first operation described above before providing the 1st current red data to the data line connected to the 3rd pixel.

On the other hand, the 3rd pixel receives image data corresponding to the negative white and the 4th pixel also receives image data corresponding to the negative white. That is, it can be seen that the 3rd and 4th pixels have the same polarity. Thus, a previous vertical polarity reversal control signal vPOL_n−1 that has been provided to the 3rd pixel and a current vertical polarity reversal control signal vPOL_n that will be provided to the 4th pixel have the same value if the 3rd pixel is the previous pixel and the 4th pixel is the current pixel. Here, the difference between the level of the 1st previous red data that has been provided to the 3rd pixel and the level of the 1st current red data that will be provided to the 4th pixel is 0 since both the 1st previous red data and the 1st current red data have the 4th level corresponding to white. Accordingly, the data driver DD performs the second operation described above before providing the 1st current red data to the data line connected to the 4th pixel. That is, the data driver DD provides corresponding current data to the 6 data lines connected to the 6 output channels after keeping the 6 output channels disconnected from each other.

Figure 10:
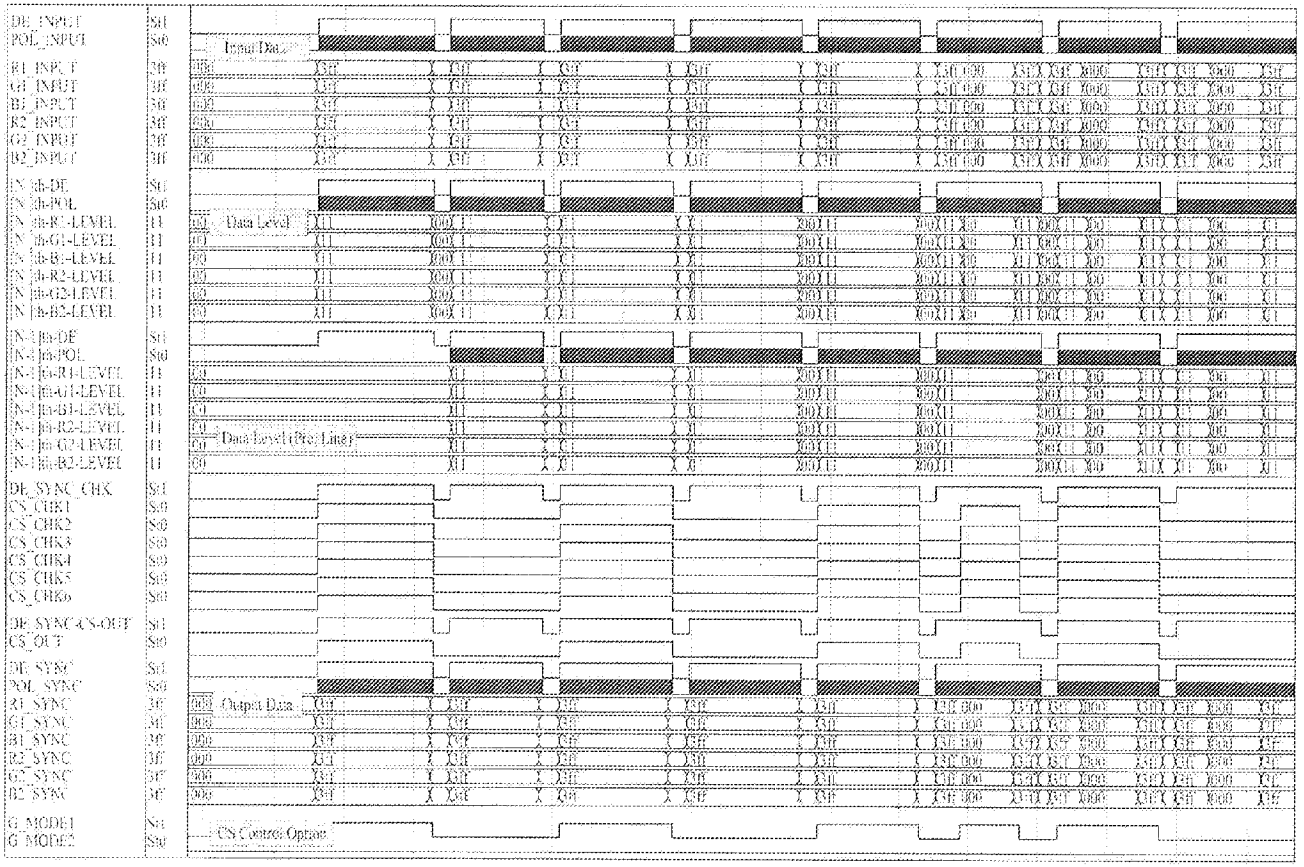
FIGS. 10 to 12 illustrate results of simulation experiments of operation of a display device using a preparatory charging controller PCCB according to an embodiment of the present invention.
Figure 11:
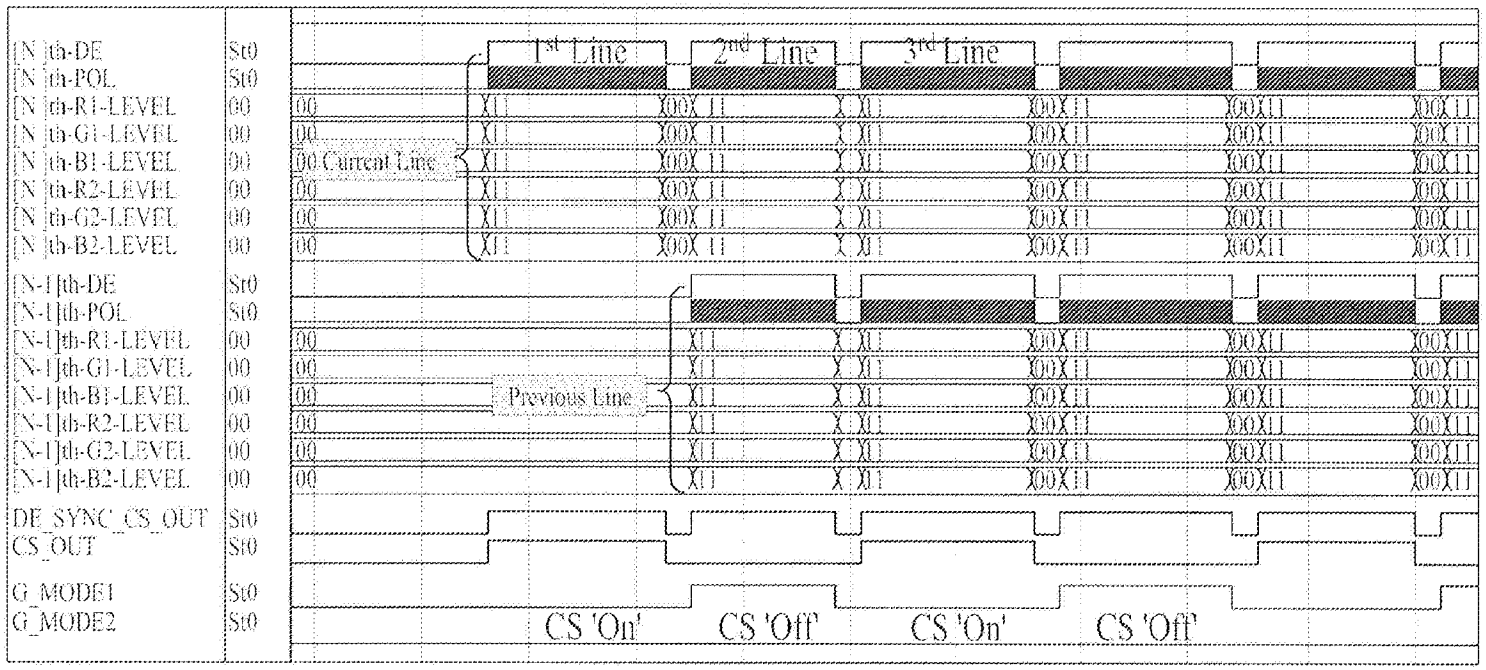
Figure 12:
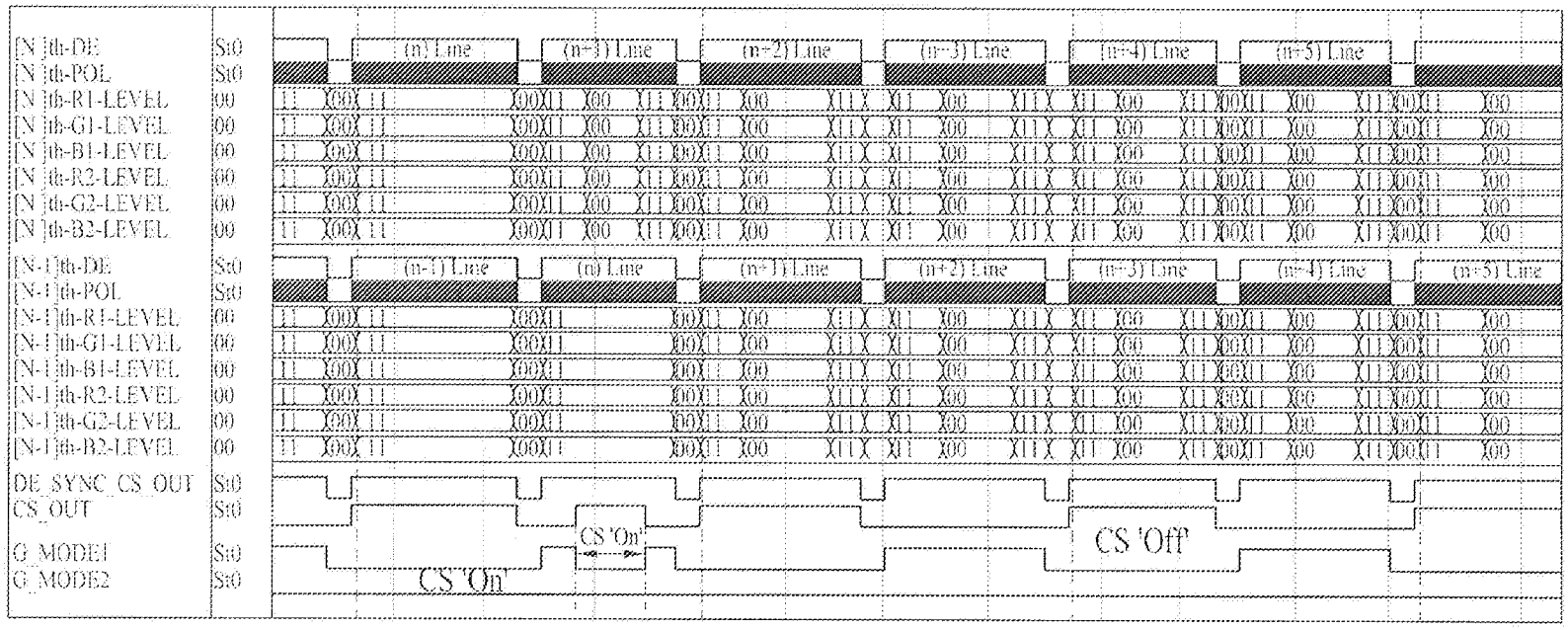

FIGS. 10 to 12 illustrate results of simulation experiments of operation of a display device using a preparatory charging controller PCCB according to an embodiment of the present invention.

FIG. 11 shows the simulation result subsequent to that of FIG. 10. In the simulation experiments of FIGS. 10 and 11, polarities of pixels are controlled such that the polarities are reversed in a horizontal direction in a 2-dot reversal manner. FIGS. 10 and 11 show results of simulation experiments of the white background (of the 2nd region #2) of FIG. 8.

A charge share operation is performed for the 1st horizontal line of a frame since the 1st horizontal line of the frame is the first load of a frame blank duration.

The 1st horizontal line, which is immediately prior to the 2nd horizontal line, has the same polarity as the 2nd horizontal line and is white and therefore a charge share operation is performed for the 1st horizontal line and the 2nd horizontal line.

The 3rd horizontal line and the 2nd horizontal line, which is immediately prior to the 3rd horizontal line, have opposite polarities and therefore a charge share operation is performed for the 2nd horizontal line and the 3rd horizontal line.

It is more advantageous in terms of charging effects that a charge share operation be performed when the current horizontal line has a different polarity from the previous horizontal line as described above.

On the other hand, it is more advantageous in terms of charging effects that a charge share operation is not performed when the current horizontal line and the previous horizontal line have the same polarity and a similar data level.

In the simulation experiment of FIG. 12, polarities of pixels are controlled such that the polarities are reversed in a vertical direction in a 2-dot reversal manner. FIG. 12 also shows the results of a simulation experiment of FIG. 8.

The nth horizontal line HLn is the 1st horizontal line in which a polarity change has occurred. A charge share operation is performed since the polarity of the current horizontal line has changed from the polarity of the previous horizontal line although the previous horizontal line is white and the current horizontal line is also white.

The polarity of the n+1th horizontal line HLn+1 is kept equal to that of the previous horizontal line and the difference between the data level of the n+1th horizontal line HLn+1 and that of the previous horizontal line is 3 levels or more. The previous horizontal line is maintained at white and the current horizontal line is a mixture of white and black. The white region of the n+1th horizontal line HLn+1 is maintained at the same polarity and the same data level as the previous horizontal line and therefore a charge share operation is not performed.

When the nth horizontal line HLn is white and the n+1th horizontal line HLn+1 is black, a charge share operation is performed if the two horizontal lines have the same polarity and different data levels.

The n+2th horizontal line is the 1st line in which a polarity change has occurred and therefore a charge share operation is performed.

As is apparent from the above description, a liquid crystal display device and a method for driving the same according to the present invention have the following advantages.

According to the present invention, the difference between levels of data provided to pixels of a current horizontal line and pixels of a previous horizontal line is determined and whether or not polarity reversal control signals provided to the pixels of the current horizontal line and the pixels of the previous horizontal line are identical is also determined and a charge share operation is selectively performed according to results of the determinations, thereby efficiently increasing charge speed of data lines according to data characteristics. This can increase image quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a preparatory charging controller that receives, from a timing controller, current image data that are to be provided to m current pixels, where m is a natural number, among a plurality of pixels located at an nth horizontal line, where n is a natural number, and a current vertical polarity reversal control signal for controlling polarities of the current image data in a vertical direction, compares the current image data with previous image data that have been provided to m previous pixels corresponding to the current m pixels among a plurality of pixels located at an n−1th horizontal line, compares the current vertical polarity reversal control signal with a previous vertical polarity reversal control signal for controlling polarities of the previous image data in a vertical direction, and determines a logic value of a preparatory charging control signal based on results of the comparisons; and a data driver that performs one of a first operation, in which the data driver connects m data lines connected respectively to the m current pixels to each other and again separates the m data lines from each other, and a second operation, in which the data driver keeps the m data lines separated from each other, according to the logic value of the preparatory charging control signal from the preparatory charging controller and then provides the current image data from the timing controller to the m pixels wherein in the first operation, the m data lines for the m current pixels are connected to an average voltage that is charged in the m data lines and thereby set the same said average voltage for the m data lines, and in the second operation, the m data lines for the m current pixels are kept separated to maintain the voltages that are charged in the m data lines, respectively.

2. The liquid crystal display device according to claim 1, wherein the preparatory charging controller compares k most significant bits of the current image data with k most significant bits of the previous image data, where k is a natural number.

3. The liquid crystal display device according to claim 2, wherein the preparatory charging controller includes:

a most significant bit extractor that receives the current image data and the current vertical polarity reversal control signal from the timing controller and extracts current most significant bits corresponding to the k most significant bits from the current image data;

a storage unit that stores the current most significant bits and the current vertical polarity reversal control signal from the most significant bit extractor, wherein a previous vertical polarity reversal control signal and previous most significant bits corresponding to k most significant bits of the previous image data have already been stored in the storage unit; and a preparatory charging determinator that compares the current most significant bits from the most significant bit extractor with the previous most significant bits from the storage unit, compares the current vertical polarity reversal control signal from the most significant bit extractor with the previous vertical polarity reversal control signal from the storage unit, and determines a logic value of the preparatory charging control signal based on results of the comparisons.

4. The liquid crystal display device according to claim 3, wherein the m current pixels include 1st and 2nd current red pixels for displaying a red image, 1st and 2nd current green pixels for displaying a green image, and 1st and 2nd current blue pixels for displaying a blue image, the 1st current red pixel, the 1st current green pixel, and the 1st current blue pixel constitute a 1st current unit pixel for displaying one unit image, the 2nd current red pixel, the 2nd current green pixel, and the 2nd current blue pixel constitute a 2nd current unit pixel for displaying one unit image, the m previous pixels include 1st and 2nd previous red pixels for displaying a red image, 1st and 2nd previous green pixels for displaying a green image, and 1st and 2nd previous blue pixels for displaying a blue image, the 1st previous red pixel, the 1st previous green pixel, and the 1st previous blue pixel constitute a 1st previous unit pixel for displaying one unit image, the 2nd previous red pixel, the 2nd previous green pixel, and the 2nd previous blue pixel constitute a 2nd previous unit pixel for displaying one unit image, the current image data include 1st current red data that is to be provided to the 1st current red pixel, 1st current green data that is to be provided to the 1st current green pixel, 1st current blue data that is to be provided to the 1st current blue pixel, 2nd current red data that is to be provided to the 2nd current red pixel, 2nd current green data that is to be provided to the 2nd current green pixel, 2nd current blue data that is to be provided to the 2nd current blue pixel, and the previous image data include 1st previous red data that is to be provided to the 1st previous red pixel, 1st previous green data that is to be provided to the 1st previous green pixel, 1st previous blue data that is to be provided to the 1st previous blue pixel, 2nd previous red data that is to be provided to the 2nd previous red pixel, 2nd previous green data that is to be provided to the 2nd previous green pixel, 2nd previous blue data that is to be provided to the 2nd previous blue pixel.

5. The liquid crystal display device according to claim 4, wherein the most significant bit extractor extracts 1st current red most significant bits corresponding to k most significant bits from the 1st current red data, the most significant bit extractor extracts 1st current green most significant bits corresponding to k most significant bits from the 1st current green data, the most significant bit extractor extracts 1st current blue most significant bits corresponding to k most significant bits from the 1st current blue data, the most significant bit extractor extracts 2nd current red most significant bits corresponding to k most significant bits from the 2nd current red data, the most significant bit extractor extracts 2nd current green most significant bits corresponding to k most significant bits from the 2nd current green data, the most significant bit extractor extracts 2nd current blue most significant bits corresponding to k most significant bits from the 2nd current blue data, and the most significant bit extractor synchronizes and provides the 1st current red most significant bits, the 1st current green most significant bits, the 1st current blue most significant bits, the 2nd current red most significant bits, the 2nd current green most significant bits, the 2nd current blue most significant bits, and the current vertical polarity reversal control signal to the storage unit and the preparatory charging determinator.

6. The liquid crystal display device according to claim 5, wherein 1st previous red most significant bits corresponding to k most significant bits of the 1st previous red data, 1st previous green most significant bits corresponding to k most significant bits of the 1st previous green data, 1st previous blue most significant bits corresponding to k most significant bits of the 1st previous blue data, 2nd previous red most significant bits corresponding to k most significant bits of the 2nd previous red data, 2nd previous green most significant bits corresponding to k most significant bits of the 2nd previous green data, 2nd previous blue most significant bits corresponding to k most significant bits of the 2nd previous blue data, and the previous vertical polarity reversal control signal have already been stored in the storage unit, and the 1st previous red most significant bits, the 1st previous green most significant bits, the 1st previous blue most significant bits, the 2nd previous red most significant bits, the 2nd previous green most significant bits, the 2nd previous blue most significant bits, and the previous vertical polarity reversal control signal have been received from the most significant bit extractor.

7. The liquid crystal display device according to claim 6, wherein the preparatory charging determinator includes:

a 1st comparator that compares the current vertical polarity reversal control signal from the most significant bit extractor and the previous vertical polarity reversal control signal from the storage unit, compares the 1st current red most significant bits from the most significant bit extractor and the 1st previous red most significant bits from the storage unit, and sets a logic value of a 1st comparison signal according to results of the comparisons;

a 2nd comparator that compares the current vertical polarity reversal control signal from the most significant bit extractor and the previous vertical polarity reversal control signal from the storage unit, compares the 1st current green most significant bits from the most significant bit extractor and the 1st previous green most significant bits from the storage unit, and sets a logic value of a 2nd comparison signal according to results of the comparisons;

a 3rd comparator that compares the current vertical polarity reversal control signal from the most significant bit extractor and the previous vertical polarity reversal control signal from the storage unit, compares the 1st current blue most significant bits from the most significant bit extractor and the 1st previous blue most significant bits from the storage unit, and sets a logic value of a 3rd comparison signal according to results of the comparisons;

a 4th comparator that compares the current vertical polarity reversal control signal from the most significant bit extractor and the previous vertical polarity reversal control signal from the storage unit, compares the 2nd current red most significant bits from the most significant bit extractor and the 2nd previous red most significant bits from the storage unit, and sets a logic value of a 4th comparison signal according to results of the comparisons;

a 5th comparator that compares the current vertical polarity reversal control signal from the most significant bit extractor and the previous vertical polarity reversal control signal from the storage unit, compares the 2nd current green most significant bits from the most significant bit extractor and the 2nd previous green most significant bits from the storage unit, and sets a logic value of a 5th comparison signal according to results of the comparisons;

a 6th comparator that compares the current vertical polarity reversal control signal from the most significant bit extractor and the previous vertical polarity reversal control signal from the storage unit, compares the 2nd current blue most significant bits from the most significant bit extractor and the 2nd previous blue most significant bits from the storage unit, and sets a logic value of a 6th comparison signal according to results of the comparisons; and a preparatory charging decider that determines a logic value of the preparatory charging control signal based on the logic values of the 1st to 6th comparison signals from the 1st to 6th comparators.

8. The liquid crystal display device according to claim 7, wherein each of the comparators outputs a comparison signal having a high logic value regardless of a result of comparison between current most significant bits and previous most significant bits provided to the comparator when the current vertical polarity reversal control signal and the previous vertical polarity reversal control signal have different values.

9. The liquid crystal display device according to claim 1, wherein each of the comparators sets a logic value of a comparison signal that is to be output from the comparator based on a result of comparison between current most significant bits and previous most significant bits provided to the comparator when the current vertical polarity reversal control signal and the previous vertical polarity reversal control signal have the same value.

10. The liquid crystal display device according to claim 9, wherein each of the comparators outputs a comparison signal having a high logic value when a difference between levels of current most significant bits and previous most significant bits provided to the comparator is equal to or more than p levels, where p is a natural number and outputs a comparison signal having a low logic value when a difference between levels of current most significant bits and previous most significant bits provided to the comparator is less than p levels.

11. The liquid crystal display device according to claim 10, wherein the preparatory charging decider determines the number of comparison signals having a high logic value provided from the 1st to 6th comparators and sets the logic value of the preparatory charging control signal to a high logic value when the number of the comparison signals having a high logic value is equal to or greater than q, where q is a natural number, and sets the logic value of the preparatory charging control signal to a low logic value when the number of the comparison signals having a high logic value is less than q.

12. The liquid crystal display device according to claim 1, further comprising:

a synchronization unit that generates 1st and 2nd preparatory charging control data in response to a preparatory charging control signal from the preparatory charging controller, sets logic values of the 1st and 2nd preparatory charging control data according to a logic value of the preparatory charging control signal, synchronizes the 1st and 2nd preparatory charging control data and the current image data, the current vertical polarity reversal control signal, and a current horizontal polarity reversal control signal from the timing controller, and rearranges and outputs the synchronized 1st and 2nd preparatory charging control data, the current image data, the current vertical polarity reversal control signal, and the current horizontal polarity reversal control signal according to a data map of the data driver; and an interface unit that transmits the synchronized 1st and 2nd preparatory charging control data, the current image data, the current vertical polarity reversal control signal, and the current horizontal polarity reversal control signal from the synchronization unit to the data driver, wherein the current horizontal polarity reversal control signal is a signal for controlling polarities of current image data in a horizontal direction.

13. A method for driving a liquid crystal display device, the method comprising:

a 1st process including receiving current image data that are to be provided to m current pixels among a plurality of pixels located at an nth horizontal line and a current vertical polarity reversal control signal for controlling polarities of the current image data in a vertical direction;

a 2nd process including comparing the current image data with previous image data that have been provided to m previous pixels corresponding to the current m pixels among a plurality of pixels located at an n−1th horizontal line;

a 3rd process including comparing the current vertical polarity reversal control signal with a previous vertical polarity reversal control signal for controlling polarities of the previous image data in a vertical direction;

a 4th process including determining a logic value of a preparatory charging control signal based on results of the 2nd and 3rd processes; and a 5th process including performing one of a first operation, in which m data lines connected respectively to the m current pixels are connected to each other and the m data lines are again separated from each other, and a second operation, in which the m data lines are kept separate from each other, according to the logic value of the preparatory charging control signal and then providing the current image data to the m pixels, wherein in the first operation, the m data lines for the m current pixels are connected to an average voltages that is charged in the m data lines and thereby set the same said average voltage for the m data lines, and in the second operation, the m data lines for the m current pixels are kept separated to maintain the voltages that are charged in the m data lines, respectively.

14. The method according to claim 13, wherein the 2nd process includes comparing k most significant bits of the current image data and k most significant bits of the previous image data.

15. The method according to claim 14, wherein the 1st to 4th processes include:

receiving the current image data and the current vertical polarity reversal control signal and extracting current most significant bits corresponding to the k most significant bits from the current image data;

reading the previous vertical polarity reversal control signal and previous most significant bits corresponding to the k most significant bits of the previous image data from a storage unit;

storing the current most significant bits and the current vertical polarity reversal control signal in the storage unit; and comparing the current most significant bits with the previous most significant bits from the storage unit, comparing the current vertical polarity reversal control signal with the previous vertical polarity reversal control signal from the storage unit, and determining a logic value of the preparatory charging control signal based on results of the comparisons.

* * * * *